United States Patent [19]

Kishimoto

[11] 4,093,562

[45] June 6, 1978

[54] POLYMERIC COMPOSITIONS FOR MANUFACTURE OF SECONDARY ELECTRON MULTIPLIER TUBES AND METHOD FOR MANUFACTURE THEREOF

[75] Inventor: Yoshi Kishimoto, Hirakata, Japan

[73] Assignee: Matsushita Electric Industrial Co., Ltd., Japan

[21] Appl. No.: 769,014

[22] Filed: Feb. 16, 1977

[30] Foreign Application Priority Data

Feb. 20, 1976 Japan ..... 51-18072

[51] Int. Cl.[2] ..... H01B 1/06

[52] U.S. Cl. ..... 252/511; 252/500; 252/513; 252/514; 252/518; 313/103 CM; 313/105 CM

[58] Field of Search ..... 252/500, 511, 518; 313/103 CM, 105 CM; 428/423; 260/37 N

[56] References Cited

U.S. PATENT DOCUMENTS 3,424,698 1/1969 Lupinski et al. ..... 252/500

3,448,177 6/1969 Goodings et al. ..... 260/895

3,808,494 4/1974 Hayashi et al. ..... 252/500 X

FOREIGN PATENT DOCUMENTS 1,118,331 7/1968 United Kingdom.

*Primary Examiner*—Brooks H. Hunt

*Assistant Examiner*—E. Suzanne Parr

*Attorney, Agent, or Firm*—Burgess, Ryan and Wayne

[57] ABSTRACT

Disclosed are polymeric compositions for manufacture of secondary electron multiplier tubes. The polymeric compositions may be provided by combinations of (1) insulating polymers having a high secondary yield, (2) conductive particles such as carbon black, graphite or metal particles which may be granularly dispersed into the insulating polymers and (3) organic semiconductors soluble in and compatible with the insulating polymers and adapted to be molecularly dispersed therein. The organic semiconductors may be organic semiconducting polymers wherein the polymers themselves are conductive.

11 Claims, 5 Drawing Figures

POLYMERIC COMPOSITIONS FOR MANUFACTURE OF SECONDARY ELECTRON MULTIPLIER TUBES AND METHOD FOR MANUFACTURE THEREOF

BACKGROUND OF THE INVENTION

The present invention relates to polymeric compositions for channel type secondary electron multiplier tubes and plates or targets and a method for manufacture thereof.

The channel type secondary electron multiplier tubes have been widely used instead of the conventional separate dynode type multipliers mainly for the detection of charged particles, photons and X-rays. In general they are made of lead glass or ceramic and have an inner wall layer capable of emitting secondary electrons and having a suitable resistance. Secondary electrons emitted from the inner surface are accelerated in a high electric field so that the secondary electron emission effect may be cascaded to multiply the secondary electrons. Presently available in the market are thin-film type secondary electron multiplier tube made of a lead glass envelope with the inner wall alone capable of being semiconductive and emitting secondary electrons, and a bulk type multiplier tube wherein an envelope itself is made of a material having a suitable degree of semiconductivity and capable of secondary electron emission, the material being for instance $ZnTiO_3$ or $BaTiO_3$. Depending upon the designs, the secondary electron multiplier tubes may be divided into a linear type and a circular type. The linear type is susceptible to "ion feedback"; that is, the effect caused by the ionization of the gases in the vacuum, and tends to encounter many difficulties in practice. The circular type has been widely used, but the manufacture of the circular type electron multiplier tubes involves many problems. The advantages of the secondary electron multiplier tubes are compact size, light weight, high gain and low noise and are especially apparent of when the multiplier tubes are used in the pulse counting mode. However, they also have disadvantages in that they are very expensive and tend to be easily broken because of their construction of fragile materials.

To overcome these problems, electron multiplier tubes made of polymeric compositions capable of secondary electron emission have been devised so that their excellent moldability and flexibility may be fully utilized. An electron-conductive polymeric composition is molded into a tube to provide a bulk type flexible channel electron multiplier (FCEM) tube having high gain. In order to eliminate the adverse effect of ion feedback, the electron multiplier tubes may be curved with a suitable radius. In addition, they exhibit strong resistance to mechanical and acceleration impacts so that they can be mounted on the artificial satellites for detecting charged particles and photons.

The flexible channel electron multipliers (FCEM) are made of electron-conductive polymeric compositions having volume resistivity between $10^5$ and $10^{10}$ ohm-cm. In general, aliphatic polymers have a maximum secondary emission yield $\delta$ max higher than that of the aromatic polymers, and the higher the ionization potential of a solid polymer, the higher the secondary yield $\delta$ becomes and the maximum secondary yield $\delta$ max is obtained when the primary energy Epmax is as low as 200 to 300 eV. That is, the secondary yield $\delta$ is relatively high when the primary energy is less than 200–300 eV. As a result, an electron which is caused to repeatedly strike the inner wall of a multiplier tube at a predetermined acceleration voltage has a higher number of bombardments or strikings and a relatively high yield. The gain is expressed by $$G = \delta^n$$

so that a high gain of $10^8$ is obtained at an acceleration voltage of 3 kV.

In general, the electron-conductive polymeric composition for an electron multiplier may be divided into (I) granularly dispersed polymeric compositions in which carbon black, graphite or metal are granularly dispersed in an insulating polymer having a relatively high secondary yield, (II) molecularly dispersed polymeric compositions wherein an organic semiconductor is molecuraly dispersed or dissolved in an insulating polymer having a relatively high secondary yield and (III) organic semiconducting polymers having inherent secondary electron emission capability. These compositions are disclosed in U.S. Pat. No. 3,808,494, British Pat. No. 1,288,816, Canada Pat. No. 883,443 and German Pat. No. 1,964,665 all of which are assigned to the present applicant. For instance, a secondary electron multiplier made of the compositions disclosed in these patents has a high gain of $10^8$ at an acceleration voltage of 3 kV, but subsequent analyses showed that the count rate dependency of gain varies widely, as will be described below.

The secondary electron multiplier tubes made of the granularly dispersed polymeric compositions (I) have poor count rate dependence. More particularly, with increase in count rate, the gain starts to decline at a count rate considerably lower than the theoretical critical rate so that saturation of output current occurs. However the secondary electron multiplier tubes made of the molecularly dispersed polymeric compositions (II) or organic semiconducting polymers (III) exhibit excellent count rate dependence substantially similar to the theoretical one. That is, the gain will not decrease even at a high count rate so that a large output current may be obtained. However, few of these compositions (II) or (III) have a sufficiently high volume resistivity of $10^5$–$10^{10}$ ohm-cm and desired moldability. Furthermore their heat deterioration is quick and they generate gases upon decomposition. Thus there has been a problem that the electron multiplier tubes cannot be easily made of these compositions (II) or (III).

SUMMARY OF THE INVENTION

In view of the above, one of the objects of the present invention is to provide polymeric compositions for secondary electron multipliers having excellent count rate dependence of gain and an electrical resistance which is less dependent upon temperature than that of prior art compositions.

Another object of the present invention is to provide moldable polymeric compositions for secondary electron multipliers having high resistance to heat and a method for manufacture thereof.

To the above and other ends, the present invention provides polymeric compositions for secondary electron multipliers wherein molecularly dispersive particles and granularly dispersive particles are mixed.

DESCRIPTION OF THE PREFERRED EMBODIMENTS

First the results of the extensive analyses made by the inventor of the relation between the types of secondary electron emissive materials consisting of electron conductive polymeric composition the secondary electron multiplication characteristics will be described.

(I) Granularly Dispersed Polymeric Compositions

Figure 1:
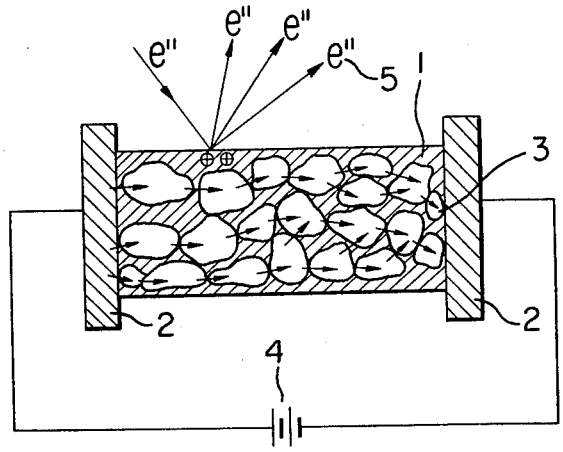
FIG. 1 is a view used for the explanation of the conduction and electron emission of a granularly dispersed polymeric composition.

In general the higher the ionization potential of a solid polymer the higher the secondary emission yield $\delta$ becomes. This explains the fact that aliphatic polymers have a higher secondary emission yield than aromatic polymers and that there is a tendency that insulating polymers have a higher yield $\delta$ opposite to the properties of polymeric organic semiconductors whose conductivity is attributed to conjugated $\pi$-electrons. Therefore it is very easy to select insulating polymers having a higher secondary yield $\delta$ and excellent moldability. These selected polymers are used as matrix polymers, to which are added granularly dispersive particles such as carbon, graphite, metal or metal oxides. This mixture is kneaded to provide a secondary electron emissive polymeric composition having a volume resistivity of the order of $10^5$ to $10^{10}$ ohm-cm. The granularly dispersive particles refer to electrically conductive particles which exhibit no solubility to matrix polymers and which are dispersed in them in the form of granules or particles. In general, they are finely divided particles of silver, nickel and other metals, carbon black and graphite. When these granularly dispersive particles are kneaded with a polymer, an electrical resistance of this composition is dependent upon the number of conductive particles in contact with each other as shown in FIG. 1, and the electrons drift through channels formed by the conductive particles in the matrix polymer. In FIG. 1, reference numeral 1 denotes a matrix polymer; 2, electrodes; 3, granularly dispersive conductive particles; 4, a DC power source; and 5, secondary electron emitted from the surface of the polymer 1.

Figure 2:
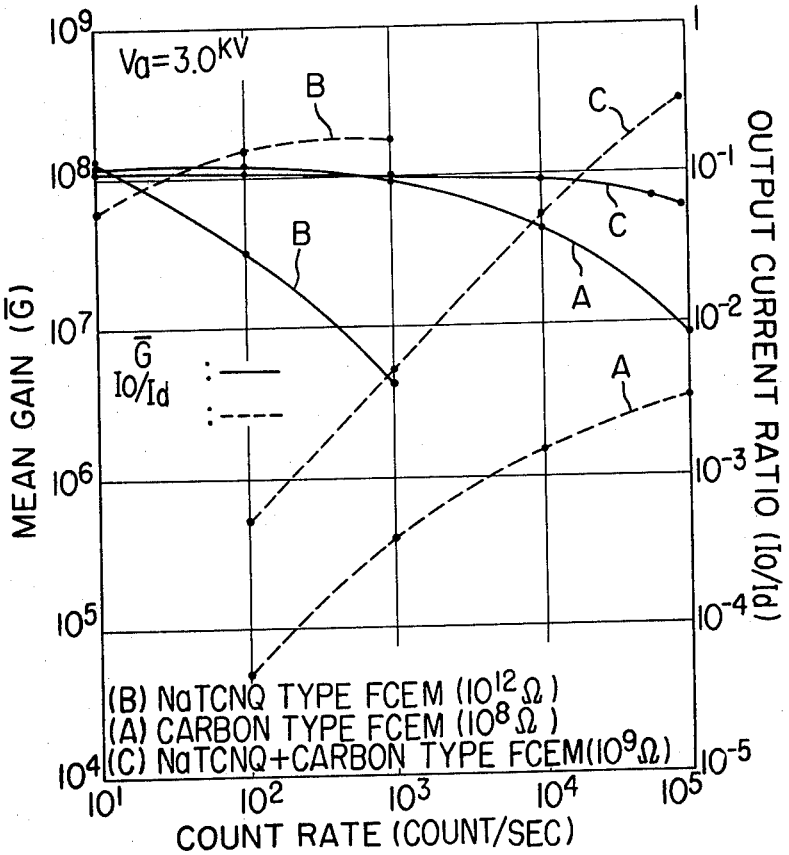
FIG. 2 shows the count rate dependence characteristic curves, A indicating the characteristic curve of a granularly dispersed type FCEM; B, that of a molecularly dispersed type FCEM; and C, that of an FCEM in accordance with the present invention.

For instance, a composition consisting of polyvinyl chloride and polyurethane are used as a matrix polymer, and carbon black (with an average particle size = 400A) is added to the matrix polymer. The count rate dependence of a secondary electron multiplier tubes formed from the electron-conductive polymeric compositions thus prepared into a tube (with an inner diameter of 1.2 mm, an outer diameter of 3.6 mm and a length of 11 cm) is shown in FIG. 2.

The multiplier tube exhibited a volume resistivity of $10^6$ ohm-cm and resistance of $10^8$ ohms and had a gain of $10^8$. With increase in count rate, the gain decreased considerably, and the output current ratio $Io/Id$ (where $Io$ = output current, and $Id$ = tube current) did not reach a theoretical limit of $10^{-1}$, but was saturated at $10^{-2}$ to $10^{-3}$. The combinations of other granularly dispersive particles and polymers resulted in further drop in count rate dependence, and in most cases the saturation occured at the output current ratio of $10^{-5}$. The characteristic curve A in FIG. 2 is of the most satisfactory secondary electron emissive composition in which were dispersed carbon black of a relatively small average particle size of 400A and which was made in such a way that these conductive particles were optimumly oriented. Thus it was found out that the secondary electron multiplier tubes capable of obtaining a greater output current almost equal to a theoretical limit cannot be made of these granularly dispersed polymeric compositions.

Figure 3:
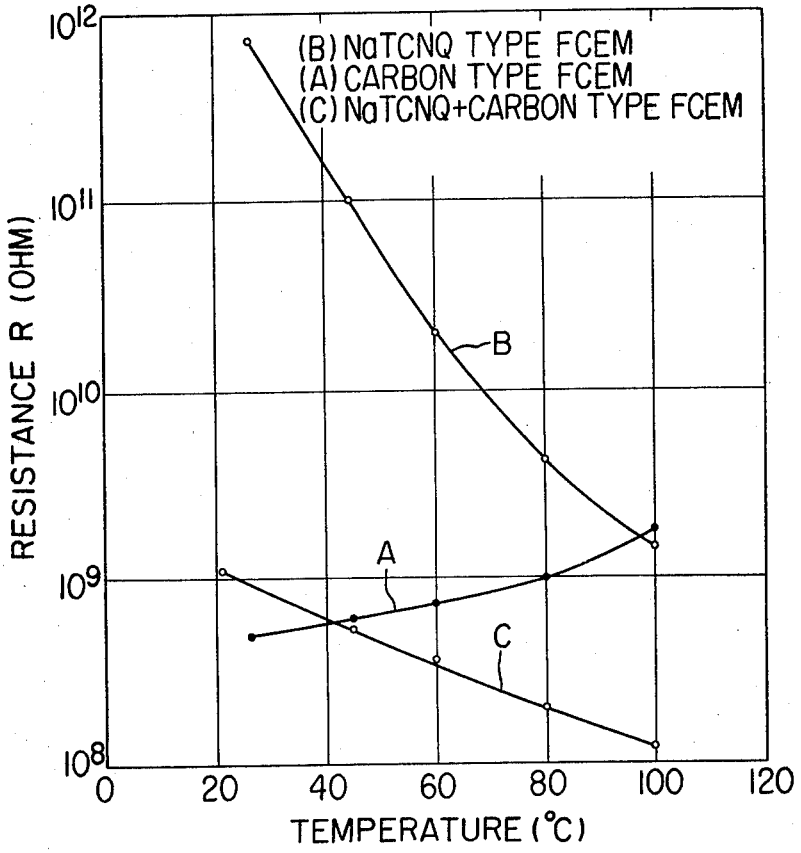
FIG. 3 is a graph illustrating the temperature dependence of electrical resistance of each FCEM; A indicating the characteristic curve of a granularly dispersed polymeric composition; B, that of a molecularly dispersed polymeric composition; and C, that of polymeric composition in accordance with the present invention.

However, as indicated by the characteristic curve A in FIG. 3, the electrical resistance of the above granularly dispersed polymeric composition is less dependent on temperature and has a positive, even though small, temperature coefficient. This is a very advantageous property of the secondary electron multiplier tubes when used in practice.

(II) Molecularly Dispersed Polymeric Compositions

Figure 4:
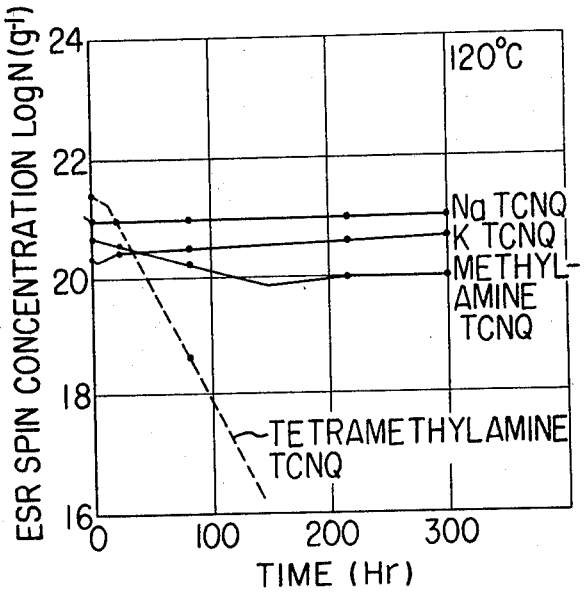
FIG. 4 is a graph illustrating the spin concentrations (radical concentrations); that is, thermal stability of charge transfer complexes such as KTCNQ, NaTCNQ, tetramethylammonium TCNQ and methylammonium TCNQ.

The matrix polymers must have a higher secondary yield $\delta$ and excellent moldability. The molecularly dispersive conductive molecules refer to organic semiconductors which are soluble to and molecularly dispersed in matrix polymers, and are most preferably charge-transfer complexes and are in general ion radical salts. Of these conductive molecules, ion radical salts whose electron acceptor is 7,7,8,8-tetracyacyanoquinodimethane (to be referred to as "TCNQ" in this specification) or a haloquinone such as p-chloranil are dispersed in polar or electron donor polymers to provide molecularly dispersed polymeric composition. Of these molecularly dispersive conductive molecules, TCNQ salt has a high conductivity and is most stable, but most of TCNQ radical salts whose electron donors are molecules containing nitrogen (for instance, amines) cannot be mixed and kneaded with polymers at a molding temperature higher than 150° C because of their melting and decomposition points less than 150° C. Of these TCNQ salts, those which can withstand a molding temperature up to 200° C are metal TCNQ salts whose electron donors are metals (especially alkali metals) as shown in FIG. 4. However, these stable metal TCNQ salts have a defect that their volume resistivity is as high as $10^3$ to $10^6$ ohm-cm. As an example shown is the characteristics of a secondary electron multiplier tube formed from a molecularly dispersed polymeric composition with a volume restivity of $10^{10}$ ohm-cm which was prepared by mixing and kneading finely divided particles of NaTCNQ (with a volume resistivity of $10^5$ ohm-cm) with the matrix polymer consisting of polyvinyl chloride (PVC) and polyurethane (PU). Since the conductive molecules of NaTCNQ have a high volume resistivity of $10^5$ ohm-cm, it is very difficult to prepare a PVC + PU + NaTCNQ composition having volume resistivity less than $10^{10}$ ohm-cm without adversely affecting moldability. (In general, when an additive is added more than 40% by volume, the moldability of the polymeric composition is adversely affected.) The multiplier tube formed from this composition exhibit a high gain of $10^8$ and its count rate dependence is indicated by the characteristic curve B in FIG. 2. It is seen that even though the output current ratio $Io/Id$ is equal to a theoretical limit of $10^{-1}$, the decrease in count rate dependence starts at a low count rate. The reason is that the resistance of this multiplier tube is very high and $10^{12}$ ohm-cm (the volumetric resistivity = $10^{10}$ ohm-cm). In other words, the composition has a defect that its resistance cannot be decreased to $10^8$–$10^9$ ohm-cm (in terms of the volumetric resistivity $10^6$ to $10^7$ ohm-cm), and in addition, the electrical resistance of the multiplier tube had a large negative temperature coefficient as indicated by the characteristic curve B in FIG. 3. These are substantial disadvantages in practice.

In summary, even though the secondary electron multiplier tubes made of the molecularly dispersed polymeric composition have excellent electron multiplication characteristic, their volume resistivity is as high as $10^{10}$ ohm-cm which is higher than an optimum resistivity of $10^6$ to $10^9$ ohm-cm. In addition, the molecularly dispersed polymeric composition had poor thermal stability and exhibit a high temperature coefficient of resistance. For these reasons molding of electron multiplier tubes consisting of the molecularly dispersed polymeric composition has been difficult in practice.

The inventor has succeeded in providing novel and excellent secondary electron emissive materials which exhibit synergistic effects due to combinations of the above described polymers (I) and (II). The reasons why the secondary electron multiplier tubes formed from the granularly dispersed polymeric composition (I) have a lower maximum output current are that even though their resistance is as low as $10^8$ ohm-cm ($10^6$ ohm-cm in terms of the volume resistivity), the resistance of the matrix polymer micro-domains cannot be lowered because the granularly dispersive conductive particles does not dissolve into the matrix polymers so that when the secondary electrons 5 are emitted as shown in FIG. 1, the supply of electrons from the conductive particles is insufficient for netralizing the positive charged surface. Therefore according to the present invention, the molecularly dispersive conductive molecules are added to the matrix polymers to obtain a volume resistivity of less than $10^{11}$ ohm-cm, and the granularly dispersive conduction particles are further added to reduce a volume resistivity as low as $10^5$–$10^9$ ohm-cm. Thus the electron-conductive polymeric composition having an optimum resistivity may be provided for the production of secondary electron multiplier tubes. Since the matrix polymer microdomains have a resistivity of less than $10^{11}$ ohm-cm so that the electron drift may be much facilitated, the supply of electrons to the surface from which are emitted the electrons may be considerably facilitated through conduction channels mainly consisting of the granularly dispersive conductive particles and having an optimum restivity of $10^5$–$10^9$ ohm-cm. When a polymeric composition consisting of an insulating matrix polymer and molecularly dispersive conductive molecules has a volume resistivity higher than $10^{11}$ ohm-cm, it does not exhibit the features and advantages of the secondary electron emissive polymeric compositions in accordance with the present invention. However, when it has volume resistivity between $10^8$ and $10^{11}$ ohm-cm, granularly dispersive conductive particles may be further added so that the surprising effects of the present invention may be obtained because the volume resistivity may be reduced to $10^5$–$10^9$ ohm-cm. However when a volume resistivity is less than $10^8$ ohm-cm, further addition of granularly dispersive conductive particles is not necessary at all.

The secondary electron emissive polymeric compositions in accordance with the present invention have an optimum resistance and excellent secondary electron multiplication characteristics. Since the granularly dispersive particles are added less in an amount than 40% by volume, the moldability of polymeric compositions are not adversely affected, so that the compositions in accordance with the present invention may be molded in the same manner as marketed polymers and plastics used in various fields.

According to the present invention the molecularly dispersive molecules having a relatively high resistivity may be used as far as the final products or materials have a volume resistivity of less than $10^{11}$ ohm-cm so that a wide variety of molecularly dispersive molecules may be selected. As a result, excellent secondary electron multiplying materials may be provided by the selection of molecular dispersive conductive molecules which are stable and have higher thermal stability.

A further advantage is that the variation in resistance due to molding conditions is minimum. That is, the stability of resistance may be secured and the temperature dependence of resistance may be minimized.

Figure 5:
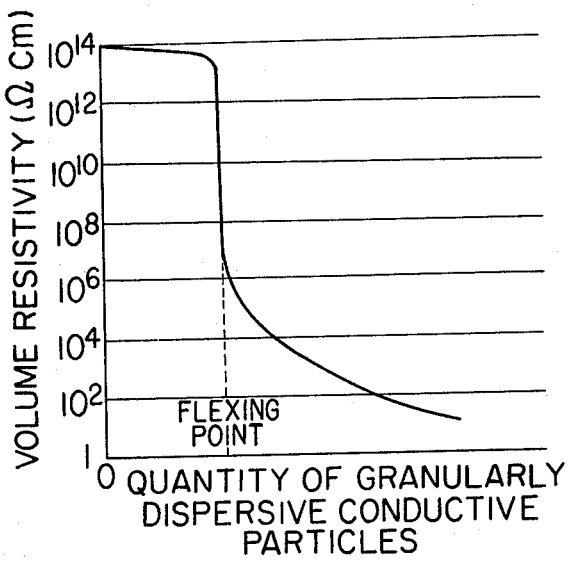
FIG. 5 is a graph illustrating the relationship between the volume resistivity and a quantity of a granularly dispersive conductive particles added to a polymer.

In general, the resistance of a granularly dispersed polymeric composition varies as shown in FIG. 5 depending upon the quantity of conductive particles added, and it is well known in the art that the resistivity varies widely over the range between $10^5$ and $10^{10}$ ohm-cm depending upon a very little variation of the quantities and the molding conditions. This resistance difference is remarkable especially when conductive particles having a chain structure such as carbon black is added. On the other hand, the molecular dispersed polymeric compositions (II) exhibit stable resistivity regardless of the shapes into which they are formed and the molding conditions.

As described above, the electron emissive polymeric compositions containing both the granularly dispersive conductive particles and molecularly dispersive conductive molecules have resistance the variation of which is extremely small and a small negative temperature coefficient as indicated by the characteristic curves C in FIG. 3. For instance, as shown by the characteristic curve C in FIG. 3 the temperature dependence of resistance is very small. This means that the secondary electron emissive polymeric compositions in accordance with the present invention exhibit very stable resistivity. In addition, they have negative and low temperature coefficient, opposed to the molecularly dispersed polymeric compositions (II). The reason is that a negative and high temperature coefficient of a molecularly dispersed polymeric composition is compensated by the addition of granularly dispersive conductive particles which impart to the polymeric composition the positive temperature dependence of resistance. Thus the present invention provides excellent secondary electron emissive polymeric compositions especially adapted for forming secondary electron multiplier tubes.

Next chemical compounds will be described which may be used in the present invention. As molecularly dispersive conductive molecules it is preferable to use charge-transfer complex type organic semiconductors whose electron acceptors are tetracyanoethylene, TCNQ, p-chloranil, trinitrobenzene and the like, whose electron donors are amines, aniline derivatives, tetrathiofluvalene, phenothiozine, onium cations and metals. Since they are mixed and kneaded with matrix polymers and formed into a suitable shape by extrusion molding or the like, they must have sufficient thermal stability at molding temperatures and must not be decomposed, generating gases. Therefore, as described hereinafter, metal TCNQ salts are preferable, and more preferably NaTCNQ and KTCNQ may be used. However, their resistance to heat may not be taken into consideration when they are added to a matrix polymer which is dissolved into a solvent and applied to form a secondary electron emissive layer or the like. In this case, it is preferable to select molecularly dispersive conductive molecules having a relatively low vapor pressure, and such selection is very easy.

Matrix polymers to which are added the molecularly dispersive conductive molecules (charge-transfer complexes) must be of the polar type and must have a high secondary yield. For instance, they are PVC, PU, polyvinyl fluoride, silicone resins, polyvinyl acetate, polyvinilidene fluoride, polyacrylonitrile styrene, polyesters, polyacetals, polyamides, phenol resins, epoxy resins, melamine resins and so on. In addition, their copolymers or, mixtures or compositions to which are added polar plasticizers may be used. The charge-transfer complexes are more soluble in the electron donor polymers. Therefore further used are the electron donor polymers such as polyamides, polyurethane, polyvinylpyridine, ionene, polyvinyl pyrrolidone, polyacrylamide, polyvinyl carbazole, their copolymers and mixtures. In order to improve their thermal stability and moldability, suitable additives may be added.

Since the molecularly dispersive conductive molecules described above are soluble or compatible with the matrix polymers described above, it is not necessary that all of added conductive molecules be completely dissolved in the matrix polymers as along as the final products or compositions have a volume resistivity less than $10^{11}$ ohm-cm.

As the granularly dispersive conductive particles, carbon and graphite are most commonly used, but finely divided metal particles may be also used. Of these particles, Ni and Ag particles are most stable. Carbon black has a dual function of serving as conductive particles in a polymer and reinforcing the mechanical structure thereof. Furthermore the addition of carbon black results in improved moldability, thermal stability and mechanical strength of the moldings.

In this specification, the term "particles" refer to those particles whose sizes range from 10 microns to 10 milimicrons and which are not soluble in the matrix polymer, but are granularly dispersed in it. It goes without saying that smaller particle size, provides for better and more uniform dispersion in the polymeric matrix and improves the moldability.

Next some examples of the present invention will be described.

EXAMPLE 1

25 grams of NaTCNQ was added to a mixture of 60 gram of PVC and PU to provide a mixture having a volume resistivity of $2 \times 10^{10}$ ohm-cm at 20° C. 15 grams of carbon black was further added to this mixture and kneaded at 170° C in a heated-roller. The kneaded composition was formed into a tube with an inner diameter of 1.2 mm, an outer diameter of 3.6 mm, a length of 11 cm ( = 110 mm), a cone diameter of 1 cm ( = 10 mm) and a cone length of 15 mm. Thus formed secondary electron multiplier tube had a resistance of $10^9$ ohms and exhibited excellent count rate dependence as indicated by the characteristic curve C in FIG. 2. That is, the gain was $10^8$ at 3 kV and the maximum output current ratio $Io/Id$ was 0.3, which is almost equal to a theoretical limit. Therefore the multiplier tube could be used at a high gain of $10^8$ up to $10^4$–$10^5$ counts per second (CPS).

The composition analysis showed that a material consisting of 50 to 70% of (PVC + PU), 40 to 12% of NaTCNQ and 10 to 18% of carbon black exhibits excellent counting rate dependence.

EXAMPLE 2

60 grams of polyurethane, 30 gram of KTCNQ and 17 gram of carbon black were mixed and kneaded, and the kneaded composition was formed into an secondary electron multiplier tube following the precedures of example 1. The multiplier tube had a resistance of $4 \times 10^8$ ohm, a gain of $2 \times 10^8$ at 3 kV, the maximum output current ratio $Io/Id$ of 0.3 and a maximum output current of 4.5 $\mu$A.

EXAMPLE 3

10 gram of the kneaded commposition obtained by following the procedures of example 2 was dispersed into 40 gram of tetrahydrofuran to provide paint. The paint was applied to the inner surface of an arcuate glass tube with an inner diameter of 2 mm, an outer diameter of 3.5 mm and a length of 100 mm and was dried by passing heated air. Thereafter silver paint was applied to form electrodes. The formed multiplier tube has a resistance of $3 \times 10^9$ ohms, a gain of $1.6 \times 10^8$ at 3 kV, a maximum output current ratio $Io/Id$ of 0.33 and a maximum output current $Io$ of $3.3 \times 10^{-7}$ $\mu$A.

For the manufacture of electron multiplier tubes in accordance with the present invention, in addition to the prior art methods of (1) blending and extrusion-molding, and (2) dissolving and dispersing into a solvent and applying or coating the solution or painting to the surface of moldings or substrate in suitable shape, any novel methods may be employed. That is, only the granularly dispersive conductive particles may be added to a matrix polymer, kneaded and extrusion-molded into a desired shape of a multiplier tube (for instance, into a tubular shape). Alternatively, the same polymeric composition may be dissolved in solvent and coated over a tubular mold. These moldings may be dipped into a solution containing the molecularly dispersive conductive molecules (that is, the charge-transfer type organic semiconductors) so that the conductive molecules may be doped into the moldings. Thus, the electron multiplier tubes exhibiting the same properties with those of the tubes manufactured by either of the prior art method (1) or (2) described above may be provided. However, attention should be exercised so that the composition consisting of a matrix polymer and the granularly dispersive conductive particles must have a volume resistivity of higher than $10^{10}$ ohm-cm and that the composition must be molded into a tubular form with an inner diameter of one milimeter, an outer diameter of 3.6 mm and a length of 100 mm and having a resistance of higher than about $10^{12}$ ohm. Thus formed moldings is dipped into a solution containing a charge-transfer complex so as to dope it into the modings as will be described in more detail hereinafter.

EXAMPLE 4

83 gram of polyurethane and 17 gram of carbon black were mixed, heated and kneaded, and the kneaded composition was molded into a tube with an inner diameter of 1 mm, an outer diameter of 3.6 mm and a length of 100 mm. Thus formed electron multiplier tube had resistance of $10^{13}$ ohm between the ends. The tube was dipped for one hour in solution consisting of methanol and LiTCNQ. After drying, it was heated for three hours at 120° C under a reduced pressure. The tube had resistance of $5 \times 10^9$ ohm. It was placed in a vacuum jar such as Bell Jar evacuated to $10^{-6}$ torrs in order to determine the count rate dependence by the pulse method. The gain was $9 \times 10^7$ at 3 kV and the maximum output current ratio *Io/Id*, 0.27.

In addition to the secondary electron emissive polymeric composition of (a matrix polymer + molecularly dispersive conductive molecules + granularly dispersive conductive particles), polymeric compositions consisting of (organic semiconducting polymers + granularly dispersive conductive particles) may be used. In this specification, the term "organic semiconducting polymers" refer to those compounds in which polymers themselves have conductivity and molecularly dispersed conductive molecules which are dispersed into the matrix polymers are combined by chemical bond to the main chains or branches of the matrix polymers so that the conductive sites may be formed within the chains of polymers. Therefore it is seen that the description made above is also held of the polymeric composition consisting of (organic semiconducting polymers + granularly dispersive conductive particles) because the electronic conduction of organic compounds may be attributed to the conductive channels formed between the conjugated $\pi$-electron structure sites. However, since the organic semiconducting polymers have polymer chains including the conjugated $\pi$-electron structure sites, the polymerization of these polymers is difficult in practice. Furthermore they have unsatisfactory moldability and thermal stability as compared with commonly used polymers. However, the underlying principle of the present invention may be held of the composition consisting of the (organic semiconducting polymers + granularly dispersive conductive particles) so that the effects and features of the present invention will be further enhanced with new organic semiconducting polymers to be developed. However with the conventional organic semiconducting polymers some experimental electron multiplier tubes may be provided as will be described in detail below.

EXAMPLE 5

An organic semiconducting polymer having a volume resistivity of $10^{10}$ ohm-cm was obtained by reaction between TCNQ and a part of copolymer of poly-2-vinylpyridine and vinyl acetate. 8.5 gram of the finely divided particles of this organic semiconducting polymer and 1.5 gram of carbon black were mixed and dissolved into 40 gram of dimethylformamide. The solution was dispersed with sand grinder for one hour to obtain paint. Following the procedures of example 3, the paint was coated to the inner surface of an circular glass tube, and thus formed electron muliplier tube had resistance of $7 \times 10^8$ ohms, a gain of $7 \times 10^7$ at 3 kV, and a maximum output current ratio *Io/Id* of 0.28 and a maximum output current of 1.2 $\mu$A.

The moldings formed with the polymeric composition consisting of (organic semiconducting polymers and granularly dispersive conductive particles) may be also formed with a layer of molecularly dispersive conductive molecules by the doping method similar to that described above. That is, granularly dispersive conductive particles are added to a matrix polymer of an electron donor type to provide a composition having volume resistivity of higher than $10^{10}$ ohm-cm, and the composition is molded into a shape of an electron multiplier tube. The tube is dipped into a solution containing an electron acceptor (for instance TCNQ or p-chloranil) so as to dope the electron acceptor into a layer in the vicinity of the surface, thereby completing the complex forming reaction. Thus, the charge-transfer complex layer may be formed in the vicinity of the surface, whereby the composition of (an organic semiconducting polymer + granularly dispersed conductive particles) may be formed in the vicinity of the surface as will be described in more detail below.

EXAMPLE 6

A mixture consisting of 85 grams of a kneaded composition consisting of poly-2-vinylpyridine and polyurethane, and 15 grams of carbon black was heated and kneaded. This kneaded composition was molded into a tube with an inner diameter of 1 mm, an outer diameter of 3.6 mm and a length of 100 mm. The tube had a resistance of $4 \times 10^{13}$ ohm between the ends ($4 \times 10^{11}$ ohm-cm in terms of the volume resistivity). It was dipped for 1.5 hours into an aqueous solution of tetracyanoethylene, and after drying it was heated for three hours at 100° C under a reduced pressure. The resistance between the both ends was $6 \times 10^8$ ohms, the gain was $1.6 \times 10^8$ at 3 kV, the maximum output current was 1 $\mu$A, and the maximum output current ratio *Io/Id* was 0.2.

In summary, the present invention provides very excellent polymeric compositions for the manufacture of electron multiplier tubes. With these compositions, high-gain electron multiplier tubes may be manufactured, and the gain does not vary up to the theoretical limit of count rate. In addition, a maximum output current is of the order of tens percents of a tube current. The compositions in accordance with the present invention may be selected from a wide variety of chemical compounds, and are very excellent in thermal stability, moldability, temperature dependence of resistance and mechanical strength, all of which are essential for the manufacture of electron multiplier tubes.

The secondary electron emissive polymeric compositions in accordance with the present invention may be used in the manufacture of secondary electron multiplier tubes and channel plates wherein the electron multiplier tubes are arrayed in two-dimensional manner. Since the materials have a high ionization potential of solid, the photoelectric emission occurs due to the direct incidence of high-energy electromagnetic waves such as vacuum ultraviolet rays, soft X-rays and so on so that the electron multiplier tubes may be used as a detector for these rays. In addition, they may detect charged particles such as electrons and ions with a higher degree of sensitivity. Furthermore they may be combined with photocathodes to provide photoelectron multiplier tubes. The channel plates wherein the channel electron multiplier tubes are arrayed in coplanar relation and the storage or porous type channel plates may be used in the two-dimensinal information processing of patterns. Furthermore they may be applied to a wide variety of electron tubes such as multidetectors, camera tubes, highspeed cathode ray tubes, X-ray image converters, photoelectric tubes, image intensifiers and so on.

What is claimed is:

1. A polymeric composition for the manufacture of a secondary electron multiplier, comprising a polar type or electron donor matrix polymer having a secondary electron yield higher than unity and molecularly dispersive conductive molecules and less than 40% by volume of granularly dispersive conductive particles, said composition having a volume resistivity in the range of $10^5$ to $10^{10}$ ohm-cm.

2. A polymeric composition for the manufacture of secondary electron multiplier as set forth in claim 1 wherein said molecularly dispersive conductive molecules are dispersed in said matrix polymer.

3. A polymeric composition for the manufacture of secondary electron multiplier as set forth in claim 1 wherein said molecularly dispersive conductive molecules are chemically combined with said matrix polymer.

4. A polymeric composition for the manufacture of secondary electron multiplier as set forth in claim 1 wherein said molecularly dispersive conductive molecules are charge-transfer type organic semiconductors.

5. A polymeric composition for the manufacture of secondary electron multiplier as set forth in claim 1 wherein said granularly dispersive conductive particles are carbon black or graphite.

6. A polymeric composition for the manufacture of secondary electron multiplier as set forth in claim 2 wherein said molecularly dispersive conductive molecules are metal salts of 7,7,8,8-tetracyanoquinodimethane.

7. A polymeric composition for the manufacture of secondary electron multiplier as set forth in claim 4 wherein said organic semiconductors are ion radical salts of 7,7,8,8-tetracyanoquinodimethane or haloquinone.

8. A polymeric composition for the manufacture of secondary electron multiplier as set forth in claim 2 wherein said electron donor type polymeric composition contains urethane bonds (NHCOO).

9. A polymeric composition for the manufacture of secondary electron multiplier as set forth in claim 6 wherein said metal salt is a salt of sodium or potassium.

10. A method for manufacture of a polymeric composition defined in claim 2 comprising doping electron acceptors in the vicinity of the surface of a molding comprising an electron donor type polymeric composition having a secondary electron emission yield higher than unity and containing said granularly dispersed conductive particles.

11. A method for manufacture of a polymeric composition defined in claim 2, comprising doping molecularly dispersive conductive molecules into the vicinity of the surface of a molding comprising said polymeric composition including said granularly dispersive conductive particles and said polymer which was higher secondary yield than unity.

* * * * *

UNITED STATES PATENT OFFICE

CERTIFICATE OF CORRECTION

Patent No. 4,093,562 Dated June 6, 1978

Inventor(s) Yoshio Kishimoto

It is certified that error appears in the above-identified patent and that said Letters Patent are hereby corrected as shown below:

In the Title Page, after "Inventor:", "Yoshi" should be --Yoshio--; "Hirakata" should be --Osaka-fu--.

Column 1, line 23: "tube" should be --tubes--.

lline 26: "an" should be --the--.

line 29: "Depend-" should start a new paragraph.

line 40: Cancel "of".

Column 2, line 19: "molecuraly" should be --molecularly--.

line 50: Cancel "the".

line 51: Cancel "these".

Column 3, line 23: Before "granularly" delete "a".

line 67: "are" should be --is--.

Column 4, line 2: Change "tubes" to --tube--.

line 16: "occured" should be --occurred--.

line 43: "tetracyacyanoquinodime-" should be --tetracyanoquinodime- --.

UNITED STATES PATENT OFFICE

CERTIFICATE OF CORRECTION

Patent No. 4,093,562 Dated June 6, 1978

Inventor(s) Yoshio Kishimoto

It is certified that error appears in the above-identified patent and that said Letters Patent are hereby corrected as shown below:

Column 4, line 63: "restivity" should be --resistivity--.

Column 5, line 7: "exhibit" should be --exhibits--.

line 29: "exhibit" should be --exhibits--.

line 44: "does" should be --do--.

line 47: "netralizing" should be --neutralizing--.

line 63: "restivity" should be --resistivity--.

Column 6, line 14: "added less in an amount" should be --added in an amount less--.

line 22: "far" should be --long--.

line 31: "secured" should be --ensured--.

Column 7, line 13: "hereinafter" should be --hereinbefore--.

line 31: Cancel "or" (1st occurrence).

line 56: "refer" should be --refers--.

line 60: Delete the comma.

last line: "gram" should be --grams--.

UNITED STATES PATENT OFFICE
CERTIFICATE OF CORRECTION

Patent No. 4,093,562 Dated June 6, 1978

Inventor(s) Yoshio Kishimoto

It is certified that error appears in the above-identified patent and that said Letters Patent are hereby corrected as shown below:

Column 8, lines 22 & 23: "gram" should be --grams--.

line 24: "an" should be --a--.

lines 32 & 34: "gram" should be --grams--.

line 32: "commposition" should be --composition--.

line 39: "The" should be --The thus--.

Column 9, line 3: "is" should be --are--.

line 4: "modings" should be --moldings--.

line 8: Change "gram" to --grams-- (both occurrences).

line 29: "refer" should be --refers--.

lines 62, 64 & 65: "gram" should be --grams--.

last line: "an" should be --a--.

Column 10, line 1: "and thus" should be --and the thus--.

Column 11, line 3: "storage" should be --sponge--.

UNITED STATES PATENT OFFICE

CERTIFICATE OF CORRECTION

Patent No. 4,093,562 Dated June 6, 1978

Inventor(s) Yoshio Kishimoto

It is certified that error appears in the above-identified patent and that said Letters Patent are hereby corrected as shown below:

Column 12, line 32: Before "polymer" insert --matrix--; replace "was" by --has a--.

Signed and Sealed this

*Twenty-seventh* Day of *February 1979*

[SEAL]

*Attest:*

RUTH C. MASON
*Attesting Officer*

DONALD W. BANNER
*Commissioner of Patents and Trademarks*